US009265315B1

(12) United States Patent
Frid et al.

(10) Patent No.: US 9,265,315 B1
(45) Date of Patent: Feb. 23, 2016

(54) INSERT AND METHOD FOR PRESERVING A PORTABLE RECEPTACLE

(76) Inventors: Marina Frid, Rockaway, NJ (US); Igor Roitburg, Belle Mead, NJ (US)

( * ) Notice: Subject to any disclaimer, the term of this patent is extended or adjusted under 35 U.S.C. 154(b) by 46 days.

(21) Appl. No.: 13/348,730

(22) Filed: Jan. 12, 2012

Related U.S. Application Data

(60) Provisional application No. 61/461,091, filed on Jan. 13, 2011.

(51) Int. Cl.
*B65D 81/26* (2006.01)
*A45C 1/02* (2006.01)

(52) U.S. Cl.
CPC .. *A45C 1/02* (2013.01); *A45C 1/024* (2013.01)

(58) Field of Classification Search
CPC ..... B65D 81/268; B65D 81/18; B65D 81/770406; A45C 13/002; A45C 1/024
USPC ..... 34/104, 80, 81, 202, 95.1; 36/10, 55; 206/204, 584, 523, 213.1; 150/104, 150/154
See application file for complete search history.

(56) References Cited

U.S. PATENT DOCUMENTS

| | | | | | |
|---|---|---|---|---|---|
| 1,952,131 | A | * | 3/1934 | Hiering | 150/123 |
| 1,978,970 | A | * | 10/1934 | Thornhill et al. | 150/130 |
| 2,578,324 | A | * | 12/1951 | Southwick, Jr. | 96/153 |
| 3,131,036 | A | * | 4/1964 | Hirschberg | 34/95.1 |
| 3,464,540 | A | * | 9/1969 | Stark | 206/524 |
| 4,021,871 | A | * | 5/1977 | Wortman | 5/636 |
| 4,272,264 | A | * | 6/1981 | Cullen et al. | 96/147 |
| 4,497,080 | A | * | 2/1985 | Inspector | 12/128 R |
| 4,565,287 | A | | 1/1986 | Rede et al. | |
| 4,749,392 | A | * | 6/1988 | Aoki et al. | 96/6 |
| 4,754,511 | A | * | 7/1988 | Sargent | 5/655.4 |
| 4,813,791 | A | * | 3/1989 | Cullen et al. | 383/40 |
| 4,861,632 | A | * | 8/1989 | Caggiano | 428/35.2 |
| 4,959,880 | A | * | 10/1990 | Tesch | 5/636 |
| 5,165,752 | A | * | 11/1992 | Terry | 297/214 |
| 5,291,669 | A | | 3/1994 | Khoury et al. | |
| 5,299,335 | A | * | 4/1994 | Ivester et al. | 5/641 |
| 5,308,665 | A | * | 5/1994 | Sadek et al. | 428/35.2 |
| 5,542,191 | A | | 8/1996 | Shouse et al. | |
| 5,819,347 | A | * | 10/1998 | Masuda | 5/641 |
| 5,934,808 | A | | 8/1999 | Ozeri et al. | |
| 5,950,323 | A | | 9/1999 | Wroth et al. | |
| 6,176,371 | B1 | * | 1/2001 | Tyrrell | 206/204 |
| 6,378,224 | B1 | | 4/2002 | Qualkinbush et al. | |
| 6,430,764 | B1 | * | 8/2002 | Peters | 5/641 |
| 7,530,127 | B2 | * | 5/2009 | Leifermann et al. | 5/636 |
| 7,699,913 | B2 | | 4/2010 | Grieve et al. | |
| 7,770,723 | B2 | | 8/2010 | Hajduk | |
| 7,930,837 | B1 | | 4/2011 | Huebner | |
| 7,987,547 | B2 | * | 8/2011 | Popovsky et al. | 15/104.93 |
| 2004/0074788 | A1 | * | 4/2004 | Blinkhorn et al. | 206/223 |
| 2008/0314772 | A1 | * | 12/2008 | Saari et al. | 206/204 |
| 2011/0061257 | A1 | | 3/2011 | Balsillie | |

* cited by examiner

*Primary Examiner* — Anthony Stashick
*Assistant Examiner* — James M Van Buskirk
(74) *Attorney, Agent, or Firm* — Melissa J. Pytel

(57) ABSTRACT

An insert can be used to preserve a portable, flexible receptacle such as a handbag. The insert has a filler contained in a flexible enclosure. The filler has a volume and a shape-altering capability that can non-destructively accommodate and support the receptacle internally, without misshaping it. The desiccating pack is held by the enclosure and is positioned inside the receptacle to reduce moisture and the risk of damage to the receptacle.

12 Claims, 2 Drawing Sheets

INSERT AND METHOD FOR PRESERVING A PORTABLE RECEPTACLE

CROSS-REFERENCES TO RELATED APPLICATIONS

This application claims the benefit of U.S. Provisional Patent Application Ser. No. 61/461,091, filed 13 Jan. 2011, the contents of which are hereby incorporated by reference herein.

BACKGROUND OF THE INVENTION

1. Field of the Invention

The present invention relates to devices and methods for preserving portable, flexible receptacles, such as a handbags, gloves, shoes, etc., and in particular, to preserving their shape and reducing deleterious moisture in them.

2. Description of Related Art

Handbags, slippers, gloves, shoes and other articles are often made of delicate, rare, or relatively expensive materials. Also, some articles are highly prized because of the prestige of its brand, their distinctiveness as an antique, a limited production volume, or other economic or social factors. Owners of such goods will very much want to preserve them from damage.

Taking handbags as an example, that market has experienced tremendous growth recently. The U.S. market alone is projected to reach $9 billion by 2015 and the market only appears to be poised for more growth, with the luxury segment of the market leading the way. Handbags are often treated less like a purchase and more like an investment. Accordingly, many purchasers go to great lengths to protect and preserve their handbags. To date, most of the focus has been on preserving the outside of the handbag. In fact, it is commonplace for handbags (particularly, the more expensive handbags) to be sold with a dust bag in which the bag is to be kept in order to protect it from outside elements.

Handbags and other articles are often shipped with inserts for preserving their shape. Unless such initial precautions are taken, the article might partially collapse or develop ripples or wrinkles due to gravity-induced settling or from being stacked together with other articles during shipment or storage. When an insert is used, the article will have crisp and new appearance when first removed from a shipping container. Also, the insert will maintain the article's appearance if it is put on display.

After purchase, a consumer usually discards the insert. Consequently, over time, the article tends to change shape and lose its crisp, new appearance. Even if the consumer were to keep the insert and use it when storing the article, the insert would not last long since it is typically made of nondurable materials such as cardboard, thin plastic, or crumpled tissue paper.

Some articles such as handbags are in the form of receptacles with an internal space in which moisture can be a problem. In such cases, keeping moisture under control is important to suppress mildew, mold, rust, etc. For this reason, many articles are shipped with a packet containing a desiccating agent for reducing moisture that might otherwise damage an article made with easily degraded materials such as leather, cloth, steel, etc.

To keep the desiccating packet effective, the shipping container is sealed to reduce infiltration of moist air. In some cases the article is placed in a box that is sealed with durable packing tape. Alternatively, the article may be sealed in a separate plastic bag placed in a larger box. Under these circumstances, a relatively small desiccating packet may be adequate to dry a fixed, noncirculating volume of air during shipment.

After being removed from its shipping container, the desiccating packet is often discarded and its advantage lost. The problem with internal moisture may then arise, especially since receptacles such as a handbag, will normally be kept closed to avoid forming wrinkles. Even if the desiccating packet were retained and placed inside a closed article such as a closed handbag, the packet will be inadequate because moisture will ordinarily infiltrate and replace the dry air unless the handbag is nearly airtight, which is almost never the case. In addition, the packets that are usually included tend to be very small and of limited capacity; thus, losing their effectiveness fairly quickly Aftermarket products for maintaining the shape of an article are limited and have been bulky and inconvenient. They require a user to squeeze and manipulate a resilient material in order to insert it into the article as well as to remove it. Such manipulation of the insert is also likely to damage the handbag. Moreover, providing an aftermarket device for preserving previously purchased articles such as a handbag, is hindered by the enormous diversity in the shapes and sizes of such articles.

See also U.S. Pat. Nos. 3,131,036; 4,565,287; 4,813,791; 5,291,669; 5,542,191; 5,934,808; 5,950,323; 6,378,224; 6,769,807; 7,108,425; 7,699,913; 7,770,723; and 7,930,837, as well as US Patent Application Publication No. 2011/0061257.

SUMMARY OF THE INVENTION

In accordance with the illustrative embodiments demonstrating features and advantages of the present invention, there is provided an insert for preserving a personally portable, flexible receptacle. The insert has a filler contained in a flexible enclosure. The filler has a shape altering capability to allow the insert, upon insertion, to internally accommodate without misshaping the receptacle. The insert also has a desiccating pack held by the flexible enclosure and segregated from the filler.

In accordance with another aspect of the invention, a method is provided for preserving a personally portable, flexible receptacle. The method includes the step of selecting for insertion in the receptacle a primary insert having a volume and a shape altering capability adequate to internally support without misshaping the receptacle. The insert has a desiccating pack. The method includes the step of inserting the primary insert in the receptacle to provide therein non-destructive internal support. The desiccating pack is positioned inside the receptacle to reduce moisture therein and the risk of damage to the receptacle.

Accordingly, an object of the present invention is to create an insert that can be used to preserve the appearance and/or the structural integrity of an article such as a handbag when not in use.

Another object of the invention is to reduce the effects of moisture on the article.

By employing devices and methods of the foregoing type an improved technique is achieved for preserving a receptacle, such as a handbag, gloves, shoes, a carrying bag, etc. In a disclosed embodiment, a pillow-like insert is fabricated with a filler inside a flexible fabric enclosure.

In a disclosed embodiments the filler material may be polystyrene microbeads, polyfil, feathers, seeds or other like material. The disclosed inserts also include compartment(s)

and/or other means for inserting and/or attaching desiccants such as silica gel and fragrance packets.

Some of the disclosed inserts are pliable, moldable, shapeable, and designed specifically to protect the inside of a handbag by conforming to the shape of the handbag. These may include compartment(s) and/or other means for inserting and/or attaching desiccants and fragrance packets to help reduce moisture and provide pleasant odors. In exemplary embodiments, the insert will consist of the following main components:

1. Outside shell: fabricated out of a variety of materials—from muslin to leather. The insert may be manufactured in multiple sizes to accommodate the different size bags. Two or more inserts can be combined to provide a more custom fit. The insert may also be produced to custom specifications for a particular handbag or other receptacle.

2. Desiccant/Fragrance packets: Desiccant and/or fragrance packets (or other like materials) may be inserted inside the shell to help absorb moisture and provide scents. When housed inside the shell, the packets cannot be lost. The packets may also be attached to the outside of the outside shell in a pocket, thereby enabling the user to remove and insert new or recycled packets as desired and needed.

3. Filler: Within each shell will be filler material made out of pliable material such as polystyrene microbeads, polyfil, feathers, seeds or other like material. The pliability of the filler material will ensure that the user can manipulate the insert to enable the outer shell to take on multiple shapes.

4. Handle: An optional handle may be attached to the outside of the shell to enable the user to insert and remove the insert quickly and easily. The handle can be made out of a variety of materials including fabric, ribbon and plastic.

To use the disclosed insert, one need only take the insert and place it in the interior cavity of an article, for example a handbag. By virtue of its pliability, the insert will mold to the internal shape of the article with the walls of the article resting gently on the exterior of the insert, thus keeping the article from losing its shape while not in use. When one wishes to use the article, the insert is simply removed from the handbag and put aside until the handbag must again be stored. The disclosed insert may also have pockets and/or other means for inserting and/or attaching desiccants such as silica gel and fragrance packets.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION

Figure 1:
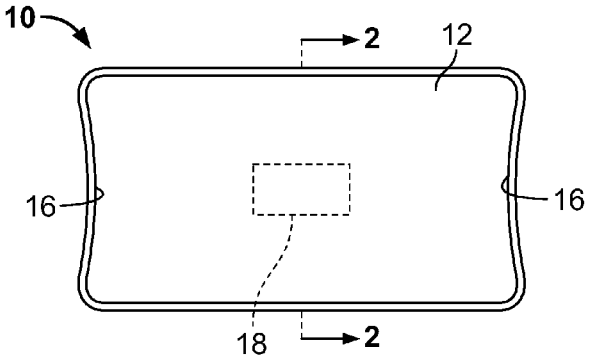
FIG. 1 is a front view of an insert in accordance with principles of the present invention.
Figure 2:
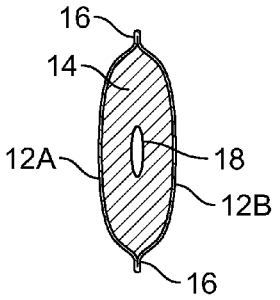
FIG. 2 is a cross-sectional view taken along line 2-2 of FIG. 1.

Referring to FIGS. 1 and 2, the illustrated insert 10 has a flexible enclosure 12 containing filler 14 and desiccating pack 18. Enclosure 12 is built from two substantially rectangular panels 12A and 12B made of an air permeable fabric, such as a material woven from cotton, material knitted with polymeric threads, material made from nonwoven synthetic fibers, etc. In some embodiments enclosure 12 may be made from muslin, air-permeable animal skins, etc. Panels 12A and 12B are stitched together on all four sides along seams 16.

Filler 14 is a material that provides support when the insert is placed inside an receptacle such as a handbag. Filler 14 can be chosen to exhibit plastic properties, elastic properties, or a combination of both. In some embodiments filler 14 may be polymeric pellets or other discrete elements, which have the property of acting like a heap whose shape can be easily altered by external pressure and will not spontaneously return to any prior shape. In other embodiments filler 14 may be an entangled mass of polymeric fibers that have elastic properties, that is, the mass will spring back to its original shape when external pressure is removed.

In other embodiments the filler may have elastic and plastic properties; for example, small chunks of polyurethane foam that are individually elastic but may change shape as the chunks change their relative position. In some embodiments filler 14 may employ polystyrene microbeads, expanded polystyrene, PVC pellets, polyfil, fibrous plastics, feathers, seeds, beans, or other like material.

In some cases filler 14 may be a shape memory material. Such a filler is pliable and does not maintain its shape. Instead this material will conform and contort to its surrounding environment. Thus, such a filler will take on the form and shape of the receptacle in which it is being inserted. As an example of such materials, known pillows are made with a shape memory foam and exhibit mostly a plastic property, in that the foam tends to mold itself to the shape of a sleeper's head and will eventually return to its original shape, but rather slowly.

In some embodiments filler 14 will have predominantly elastic properties. In such cases the elastic modulus may be at least 2 kPa and at most 500 kPa, although the actual modulus may fall in a different range for some embodiments. Basically, the modulus will be selected depending upon the desired amount of supporting force, the required malleability, etc. The modulus may be measured in various ways, including applying uniform pressure to the opposing 1 m square faces of a 10 cm thick slab of filler.

Desiccating pack 18 is shown located inside enclosure 12 surrounded by filler 14. Desiccating pack 18 may be a vapor-permeable envelope containing a desiccating agent such as a silica gel, an aluminosilicate clay compound, a molecular sieve (e.g., crystalline metal aluminosilicate zeolite), or other agent able to absorb water vapor. The envelope of pack 18 may be cloth, kraft paper, a vapor-permeable plastic (e.g., Tyvek® nonwoven synthetic sheets), or other vapor-permeable materials. The size and capacity of the desiccating pack will be selected depending upon the size of the insert 10, the volume of air to be dehumidified, the rate of air replacement, the expected humidity, etc. In one embodiment, pack 18 was commercially available and employed 2 g of silica gel in a Tyvek® envelope.

Some embodiments will employ inside the pack 18 a fragrant substance to give insert 10 and an article holding insert 10 a pleasant aroma. Alternatively, the fragrant substance can be contained in a separate pack in addition to the desiccating pack and can be either embedded in filler 14 or secured to the outside of enclosure 12.

Some embodiments will employ inside pack 18 an odor fighting substance to prevent unpleasant aromas in insert 10 or an article holding insert 10. Alternatively, the odor fighting substance can be contained in a separate pack in addition to the desiccating pack and can be either embedded in filler 14 or secured to the outside of enclosure 12. In some embodiments the odor fighting substance will be activated carbon, although other odor fighting substances can be used as well. For embodiments employing both a fragrant substance and an odor fighting substance, the fragrant emissions from the fragrant substance will be of the type that will not be captured or defeated by the odor fighting substance. The number and type of packs will vary depending on the size of the insert and its intended use.

Figure 3:
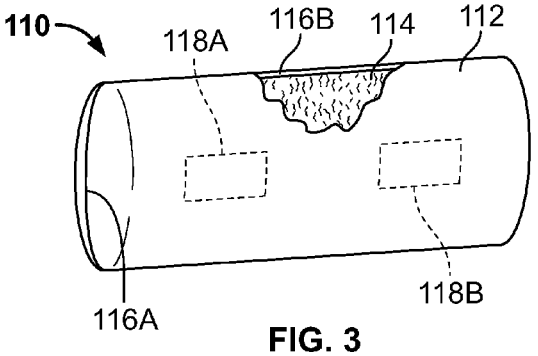
FIG. 3 is a front view of an insert that is an alternate to that of FIG. 1 and shown with a portion of the enclosure broken away for illustrative purposes.
Figure 4:
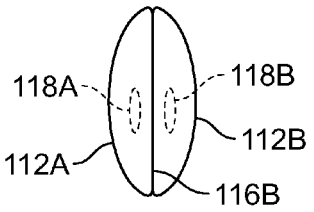
FIG. 4 is an end view of the insert of FIG. 3.

Referring to the alternative embodiment of FIGS. 3 and 4, components corresponding to those previously described will bear the same reference numerals but increased by 100. The illustrated insert 110 has a flexible enclosure 112 containing filler 114, which filler may be made of materials similar to those previously described. Enclosure 112 is again built from two substantially rectangular panels 112A and 112B made of an air permeable fabric. In this example, panels 112A and 112B are stitched together on one side along external seam 116A, and on the other three sides along internal seams 116B. Internal seams 116B are formed by stitching external seams on three sides and then turning the thus created bag inside out before stitching the bag closed. I will be understood that there are numerous other techniques for forming an enclosure.

In place of the single desiccating pack, this embodiment has two spaced desiccating units 118A and 118B, which are shown located inside enclosure 112 and surrounded by filler 114. Packs 118A and 118B are spaced about one third of the way in from the right and left ends (as viewed in FIG. 3) of insert 110, although the specific spacing may be different in other embodiments. Packs 118A and 118B are spaced equidistantly from a plane containing seams 116A and 116B (although other spacings are contemplated for other embodiments), but still remain surrounded by filler 114.

Instead of packs 118A and 118B being identical, in some embodiments one may contain a desiccating agent, while the other may contain an odor fighting substance, and/or a fragrant substance. In still other embodiments three packs may be employed, one with a desiccating agent, one with a fragrant substance, and one with an odor fighting substance. The number and type of packs will vary depending on the size of the insert and its intended use.

Figure 5:
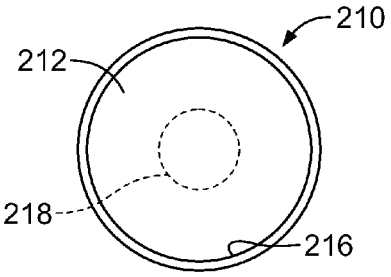
FIG. 5 is a front view of an insert that is an alternate to that of FIGS. 1 and 3.

Referring to the embodiment of FIG. 5, components corresponding to those previously described in FIG. 1 will bear the same reference numerals but increased by 200. The illustrated insert 210 has a flexible enclosure 212 that contains a filler (not shown), which may be made of materials similar to those previously described. Enclosure 212 is circular and is formed from two circular panels that are stitched together along their seams 216. Desiccating pack 218 is contained inside enclosure 212 surrounded by filler. Pack 218 is similar to those previously described except its desiccating agent is held inside a circular envelope, although the envelope need not necessarily be circular.

Figure 6:
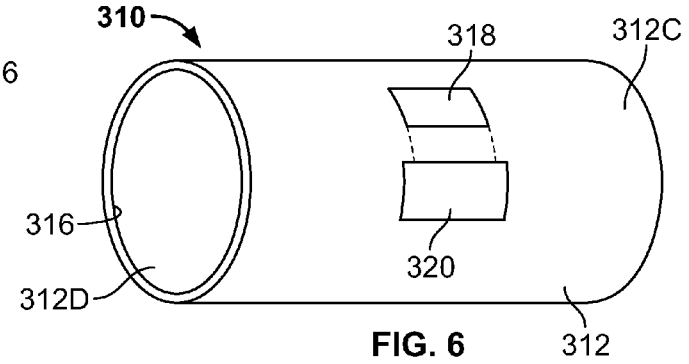
FIG. 6 is a perspective view of an insert that is an alternate to that shown in the foregoing Figures.

Referring to the embodiment of FIG. 6, components corresponding to those previously described in FIG. 1 will bear the same reference numerals but increased by 300. The illustrated insert 310 has a flexible enclosure 312 that contains a filler (not shown), which may be made of materials similar to those previously described. Enclosure 312 is essentially cylindrical and is formed from a rectangular panel 312C that has two of its opposing edges stitched together to form a tube. Alternatively, a tubular panel can be created by known knitting machines designed for such purposes. The two ends of this tube are closed by circular end panels, only one of them, panel 312D, being visible in this Figure.

External pocket 320 is stitched to the outside of panel 312C and is sized to receive desiccating pack 318, which may be the same as the desiccating packs previously described in FIGS. 1-4.

Figure 7:
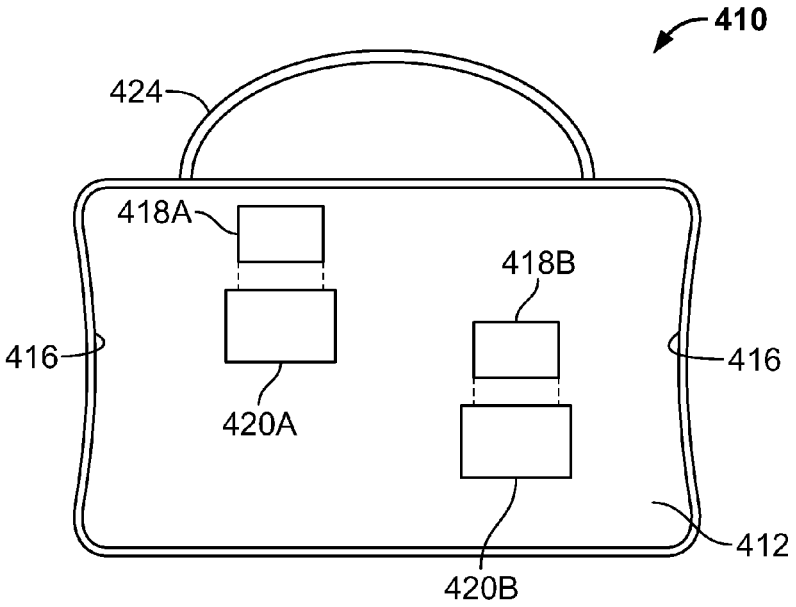
FIG. 7 is a front view of an insert that is an alternate to that shown in the foregoing Figures.

Referring to the embodiment of FIG. 7, components corresponding to those previously described in FIG. 1 will bear the same reference numerals but increased by 400. The illustrated insert 410 has a flexible enclosure 412 that contains a filler (not shown), which may be made of materials similar to those previously described. Enclosure 412 has a rectangular outline and is formed from two rectangular panels that are stitched together along their seams 416, with an opposing pair of seams external, and the other opposing pair internal.

Pockets 420A and 420B are stitched to the outside of enclosure 412. Pocket 420A is sized to receive desiccating pack 418A, which may be the same as the desiccating packs previously described in FIGS. 1-4. Pocket 420B is sized to receive pack 418A, which may contain a fragrant substance and/or an odor fighting substance.

Handle 424 is stitched to one edge of insert 410 to facilitate handling of the insert.

Figure 8:
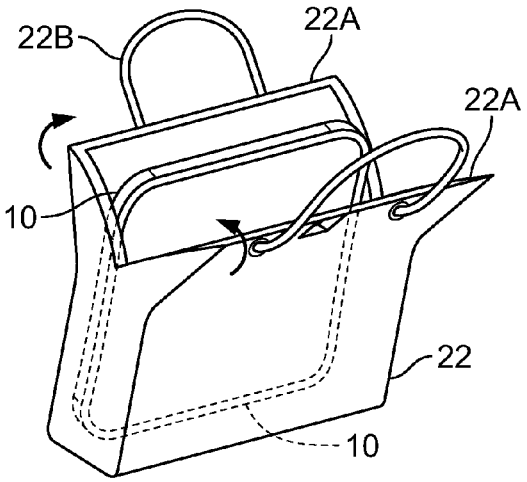
FIG. 8 is a perspective view of the insert of FIG. 1 installed in receptacle, namely, a handbag.

To facilitate an understanding of the principles associated with the foregoing, the operation of the embodiment of FIGS. 1 and 2 will be briefly described in connection with FIG. 8 showing insert 10 being applied to handbag 22. Handbag 22 is shown as a portable, flexible receptacle with two flaps 22A that may be swung together to close the handbag. A pair of handles 22B are attached to the distal edges of flaps 22A.

After being purchased, handbag 22 is used in the usual fashion by placing personal articles inside the handbag, closing and fastening flaps 22A, and carrying the handbag using handles 22B. When handbag 22 is not being used, a user may wish to store the handbag and preserve its quality and shape. Accordingly, handbag 22 will be opened and the personal articles removed therefrom. Thereafter, insert 10 may be pushed into handbag 22, eventually reaching the position shown FIG. 8.

Insert 10 is chosen because it has the approximate shape and volume of handbag 22. The shape of insert 10 may not exactly match that of the inside of handbag 22, but the insert has the capability of altering its shape and therefore can accommodate the internal contours of handbag 22.

Also, the volume of insert 10 may not match exactly the internal volume of handbag 22. In some cases the volume of insert 10 will be slightly greater, but the insert will have elastic properties that allow the insert to compress and accommodate the volume mismatch. In some cases the volume of insert 10 will be slightly less, but the insert will alter its shape to apply consistent pressure over the inside of the handbag 22, except for perhaps a few gaps in the narrower concavities of the handbag.

Once insert 10 is positioned inside handbag 22 flaps 22A will be swung together to close the handbag. Overall, the volume and shape of insert 10 will be such as to provide nondestructive support. In particular, insert 10 will avoid stretching the material of handbag 22 and will not misshape or plastically deform the handbag. In most cases the internal pressure applied to handbag 22 by insert 10 will be at most 70 kPa and in many instances the internal pressure will be much less than 70 kPa.

If filler 14 has highly plastic properties, insert 10 does not exert much pressure against the walls of the handbag 22; rather, by molding to the shape of the handbag 22, the insert 10 rests against the walls of the handbag and simply prevents the walls of the handbag from falling.

Because insert 10 provides an appropriate amount of internal support, handbag 22 will not tend to sag, wrinkle or otherwise develop ripples that detract from the appearance of the handbag. Also, desiccating pack 18 will prevent excessive moisture that can deteriorate the materials of handbag 22. In particular, pack 18 will suppress harmful mildew, mold, rust, etc.

When one wishes to again use handbag 22, flaps 22A will be opened and insert 10 removed. Personal items can then be placed inside handbag 22 before closing flaps 22A and carrying the handbag using handles 22B.

If insert 10 has now been exposed to moisture in the ambient air for a significant period of time, the desiccating agent in pack 18 may be overloaded and have lost its ability to capture water vapor. Insert 10 can then be placed in a heated environment, for example, a clothes dryer or an other heating device. By gently heating insert 10, pack 18 is heated to expel moisture captured in its desiccating agent. The temperature and the duration of this heating cycle will be chosen depending on the desiccating agent and the ability of enclosure 12 and filler 14 to withstand heat. By driving moisture from pack 18, it will maintain its ability to preserve handbag 22.

For the embodiments of FIGS. 6 and 7 this heating process is much simplified. For example, packet 318 of FIG. 6 may be removed from pocket 320 and heated inside a clothes dryer, oven or other heating device to regenerate the pack. Similarly, for FIG. 7 pack 418A (and if appropriate pack 418B) may be removed from pocket 420A (pocket 420B) in order to be heated and regenerated.

Figure 9:
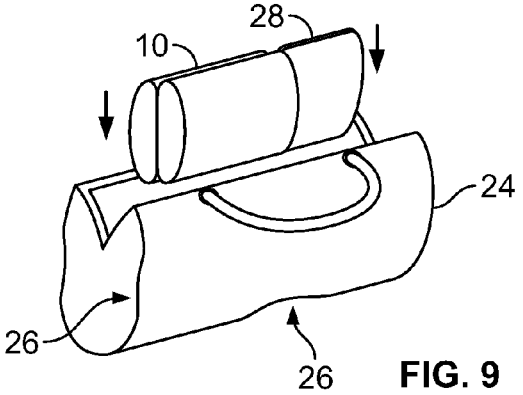
FIG. 9 a perspective view of two inserts being installed in a handbag in accordance with principles of the present invention.

Referring to FIG. 9, a relatively long bag 24 is shown with a number of irregularities, namely, ripples or wrinkles 26 that require treatment. Because of its length, previously mentioned insert 10 is incapable of adequately filling the inside of bag 24. Therefore, insert 10 is used as a primary insert but is used with a secondary insert 28. Inserts 10 and 28 are much the same except for their relative dimensional proportions. Both inserts 10 and 28 have a similar internal desiccating pack. I will be understood that in some cases a different number of inserts may be used and they may have a variety of shapes and sizes.

Inserts 10 and 28 will be pushed into bag 24, aligned end to end as shown. These inserts will have a volume and a shape altering capability such that ripples 26 will be eliminated as bag 24 expands due to the internal pressure created by the inserts 10 and 28. As before, this internal pressure applies nondestructive support that does not misshape or plastically deform bag 24.

The foregoing demonstrates that inserts need not be custom fitted to accommodate a specific receptacle. Accordingly, inserts will be provided in a variety of sizes. As an example, four different inserts were built with the following dimensions:

A. 14 inches (35.6 cm) long, 12 inches (30.5 cm) wide, 4 inches (10 cm) thick

B. 13 inches (33 cm) long, 8 inches (20 cm) wide, 3.5 inches (9 cm) thick

C. 11.5 inches (29 cm) long, 6 inches (15 cm) wide, 3 inches (7.6 cm) thick

D. 8.5 inches (21.6 cm) long, 4 inches (10 cm) wide, 2.5 inches (6.3 cm) thick

It will be appreciated that the foregoing dimensions are exemplary and that the inserts can be provided in any desired size. Also, the insert can have other shapes such as that of a sphere, hemisphere, cone, polygonal prism, ovoid, cup-shaped, saddle-shaped, etc. Also, in some cases the surface of the insert may be corrugated or may have a plurality of bumps or projections.

While the foregoing showed using inserts to preserve handbags, the inserts may be used to preserve other flexible receptacles. For example, appropriately shaped inserts of the foregoing type may be used to preserve shoes, gloves, duffel bags, hats, leather garments, purses, luggage, and various other types of personally portable, flexible receptacles.

Obviously, many modifications and variations of the present invention are possible in light of the above teachings. It is therefore to be understood that within the scope of the appended claims, the invention may be practiced otherwise than as specifically described.

The invention claimed is:

1. A removable insert configured for insertion into and for preservation of a handbag, said handbag defining an interior volume, and said removable insert comprising:

A. a pillow-like insert comprising:

i. a flexible enclosure comprising an air-permeable fabric;

ii. a fibrous filler selected from the group consisting of polystyrene microbeads, expanded polystyrene, PVC pellets, polyfil, fibrous plastics, polymeric fibers, feathers, seeds, beans, foam, and combinations thereof, wherein said fibrous filler is contained within the enclosure, and wherein said pillow-like insert has plastic properties, elastic properties, or a combination thereof to allow said removable insert, upon insertion into said interior volume of said handbag, to internally support without misshaping said handbag; and B. a desiccating pack comprising a desiccating agent disposed within a sealed envelope, wherein said desiccating pack is located within said flexible enclosure, and is spaced from said flexible enclosure and surrounded by said filler and said envelope segregates said desiccating agent from said fibrous filler.

2. The insert according to claim 1, wherein said filler has an elastic modulus of at most 500 kPa.

3. The insert according to claim 1, wherein said filler has an elastic modulus of at least 2 kPa.

4. The insert according to claim 1, wherein said filler comprises a shape memory material.

5. The insert according to claim 4, wherein said shape memory material comprises a plurality of discrete elements.

6. The insert according to claim 4, wherein said shape memory material comprises a plurality of discrete pellets.

7. The insert according to claim 1, wherein said pack is substantially centered in said enclosure.

8. The insert according to claim 1, comprising:

a fragrance packet.

9. The insert according to claim 1, wherein said desiccating pack is removable.

10. The insert according to claim 1, wherein said filler comprises polyurethane foam.

11. The insert according to claim 1, wherein said filler comprises a shape memory foam.

12. The insert according to claim 1, wherein said filler comprises multiple discrete pieces of foam.

* * * * *